US005343978A

United States Patent [19]

VanAmburg

[11] Patent Number: 5,343,978

[45] Date of Patent: Sep. 6, 1994

[54] TELESCOPING SCAFFOLDING FOR MAINTENANCE AND REPAIR OF MULTI-STORY, POWER-GENERATING BOILER SYSTEMS

[75] Inventor: Roy R. VanAmburg, Gasport, N.Y.

[73] Assignee: New York State Electric & Gas Corporation, Binghamton, N.Y.

[21] Appl. No.: 51,967

[22] Filed: Apr. 23, 1993

[51] Int. Cl.[5] ..... E04G 3/10

[52] U.S. Cl. ..... 182/128; 182/222; 182/151; 122/504; 122/379

[58] Field of Search ..... 182/128, 222, 223, 151; 122/504, 379

[56] References Cited

U.S. PATENT DOCUMENTS 2,851,311 9/1958 Gibbs ..... 182/222
4,232,636 11/1980 Prohazka ..... 182/128 X
4,276,956 7/1981 Manula et al. ..... 182/222
5,007,501 4/1991 Baston ..... 182/128

*Primary Examiner*—Alvin C. Chin-Shue
*Attorney, Agent, or Firm*—Salzman & Levy

[57] ABSTRACT

The present invention features a telescoping-type scaffold for use in the repair of superheater tubes of power-generating boiler systems. The telescoping-type scaffold is constructed in situ at the superheater bay of the firebox of the boiler. The telescoping scaffold is fabricated in sections to provide bridges between: (a) the access hatch at the superheater level of the firebox and the first tier of a pendant section of the superheater bay, (b) the first and second tiers of the pendant section, (c) the pendant and the platen sections of the superheater bay, and (d) the first and second tiers of the platen section.

6 Claims, 5 Drawing Sheets

TELESCOPING SCAFFOLDING FOR MAINTENANCE AND REPAIR OF MULTI-STORY, POWER-GENERATING BOILER SYSTEMS

FIELD OF THE INVENTION

The present invention pertains to the maintenance and repair of multi-story, power-generating boiler facilities, and, more particularly, to a new telescoping scaffolding that is extended across the upper stories of a boiler system to access the hard-to-reach platen and pendant tube sections of the superheater bays of a boiler firebox.

BACKGROUND OF THE INVENTION

The boiler firebox of a power-generating boiler facility extends upwards for many stories. When repairs are to be made, an elaborate procedure is currently required in order to access the superheater section of the boiler. This superheater section is located seven to ten stories above the floor of the firebox. It is accessed by a motorized climbing scaffold to ferry a crew to the superheater tubes, where scaffolding must be constructed.

Prior to using the motorized scaffolding, however, it is necessary to first construct a scaffolding onto the pendant section of the superheater. The tubes of the pendant and platen sections are then deslagged. The deslagging procedure is necessary, because the clinkers that have developed around the superheater tubes during the firing of the boiler can weigh as much as half a ton. Should these clinkers accidentally break off during the upward travel of the motorized scaffold, serious injury could occur to the scaffold workers. Therefore, it is imperative that these clinkers be initially removed, and then an ash hopper throat scaffold installed at the bottom of the firebox so as to support a motorized scaffolding. The cables for the motorized scaffolding are then lowered from the boiler roof and tied off at the proper length. The motorized scaffold is subsequently assembled at the floor of the firebox, and a crew thereafter raised to the platen elevation. Using the previously installed pendant scaffold and the motorized scaffold as base locations, another scaffolding is then erected to access the leak in the superheat tubes. Thereafter, the leak is repaired by removing the bad section of the tube and welding a new section in its place.

Once the repair has been accomplished, it then becomes necessary to retrace all of the aforementioned steps to disassemble the scaffold rigging. These steps include removing the pendant scaffold, lowering and disassembling the motorized scaffold, removing the motorized scaffold cables and removing the ash hopper throat scaffold.

As is evident, the above procedure is quite elaborate, time-consuming and expensive.

The present invention incorporates a new type of telescoping scaffolding that can access the superheater section from the seventh-story entrance hatch. As a result, most of the prior procedural steps can be eliminated. The telescoping scaffolding eliminates the need for deslagging, as the motorized scaffolding is no longer required. Installing the ash hopper throat scaffold, as well as the cabling for the motorized scaffolding, is, likewise, no longer necessary.

In a test run with a Babcock and Wilcox RB608 boiler, the invention has saved over $150,000 in the repair of the superheater. These savings will be realized for every subsequent repair.

While it is useful to deslag the superheater tubes periodically, this procedure can be done while the tube repair is in progress. Thus, the clean-up procedure can be more efficiently scheduled during the repair sequence.

SUMMARY OF THE INVENTION

In accordance with the present invention, there is provided a telescoping-type scaffold for use in the repair of superheater tubes of power-generating boiler systems. The telescoping-type scaffold is constructed in situ at the superheater bay of the firebox of the boiler. The telescoping scaffold is fabricated in sections to provide bridges between: (a) the access hatch at the superheater level of the firebox and the first tier of a pendant section of a superheater bay, (b) the first and second tiers of the pendant section, (c) the pendant and the platen sections of the superheater bay; and (d) the first and second tiers of the platen section. The telescoping-type scaffold is easy to use; it is readily assembled and disassembled. The scaffolding comprises a header section having two spaced-apart legs that are designed to be placed over and between the tubes of the superheater. These legs are used to anchor the header section to the superheater tier to be accessed. Tandemly attached extension bars project from the header section to bridge the gap between the superheater tiers. To achieve the proper length of scaffolding, several extension bars are bolted together. The header section is then anchored in place. Planking is then placed over the extension bars to provide a walkway between the tiers. On an underside thereof, one of the planking members comprises two spaced-apart angle bars. The angle bars are spaced the width of the extension bars and lock in place with the extension bars. Thus, the planking is secured to the extension bars, and it will not laterally shift. Additional planking can then be added to expand the width of the walkway between the tiers.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity of description, like elements and components of the invention will bear the same designation throughout the FIGURES.

DESCRIPTION OF THE PREFERRED EMBODIMENT

Generally speaking, the telescoping scaffold of the present invention comprises an easily assembled walkway that is constructed in situ in the firebox of the power-generating boiler of a power-generating facility. The scaffolding is a simple, elegant solution for repairing the superheater section of the boiler. The telescoping scaffold eliminates the complicated, labor-intensive procedure currently utilized to access this remote area of the boiler firebox.

Figure 1:
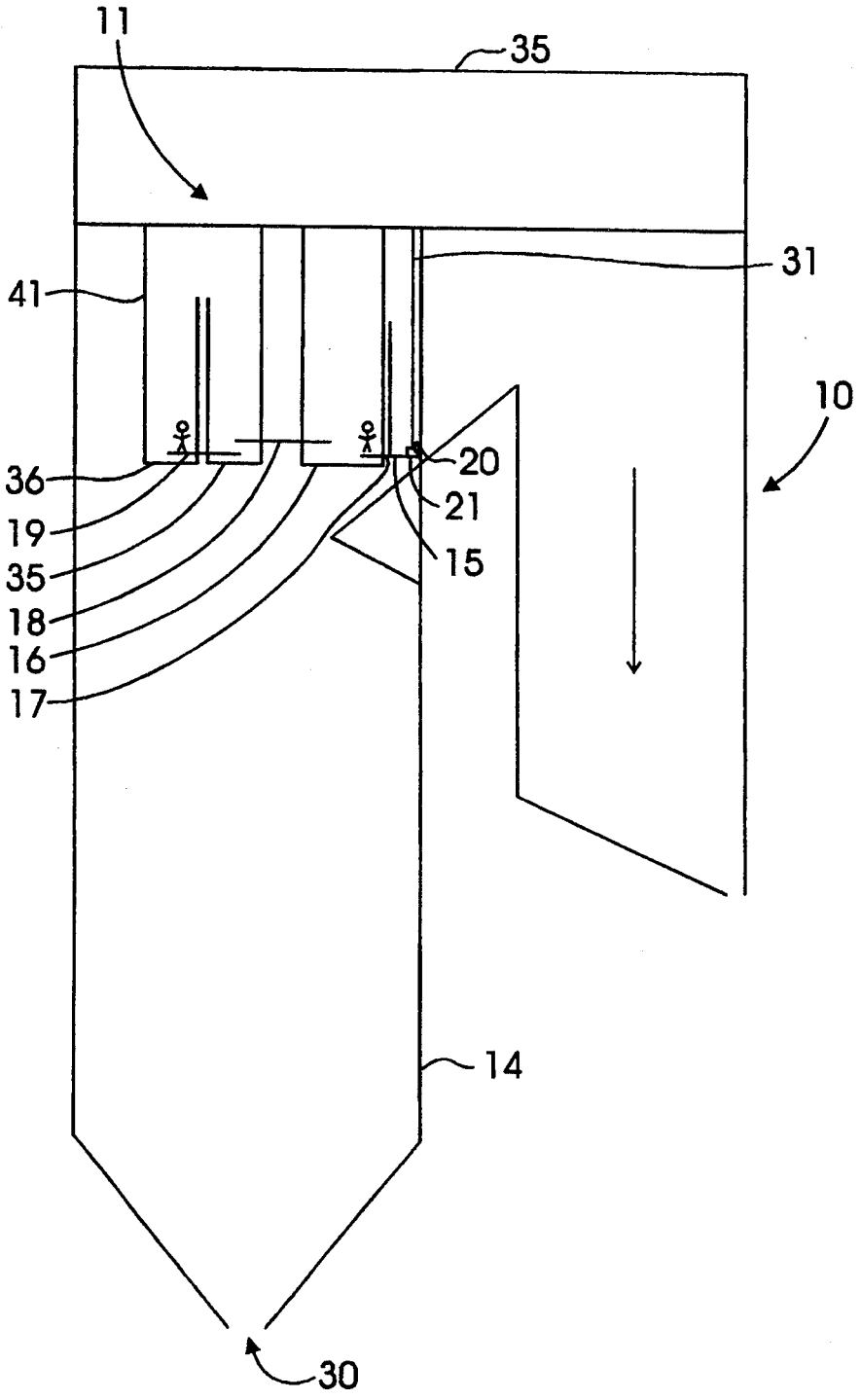
FIG. 1 illustrates a schematic diagram of a sectional view of the boiler facility containing a firebox with a superheater section that is to be repaired by the telescoping scaffolding of the present invention.
Figure 1A:
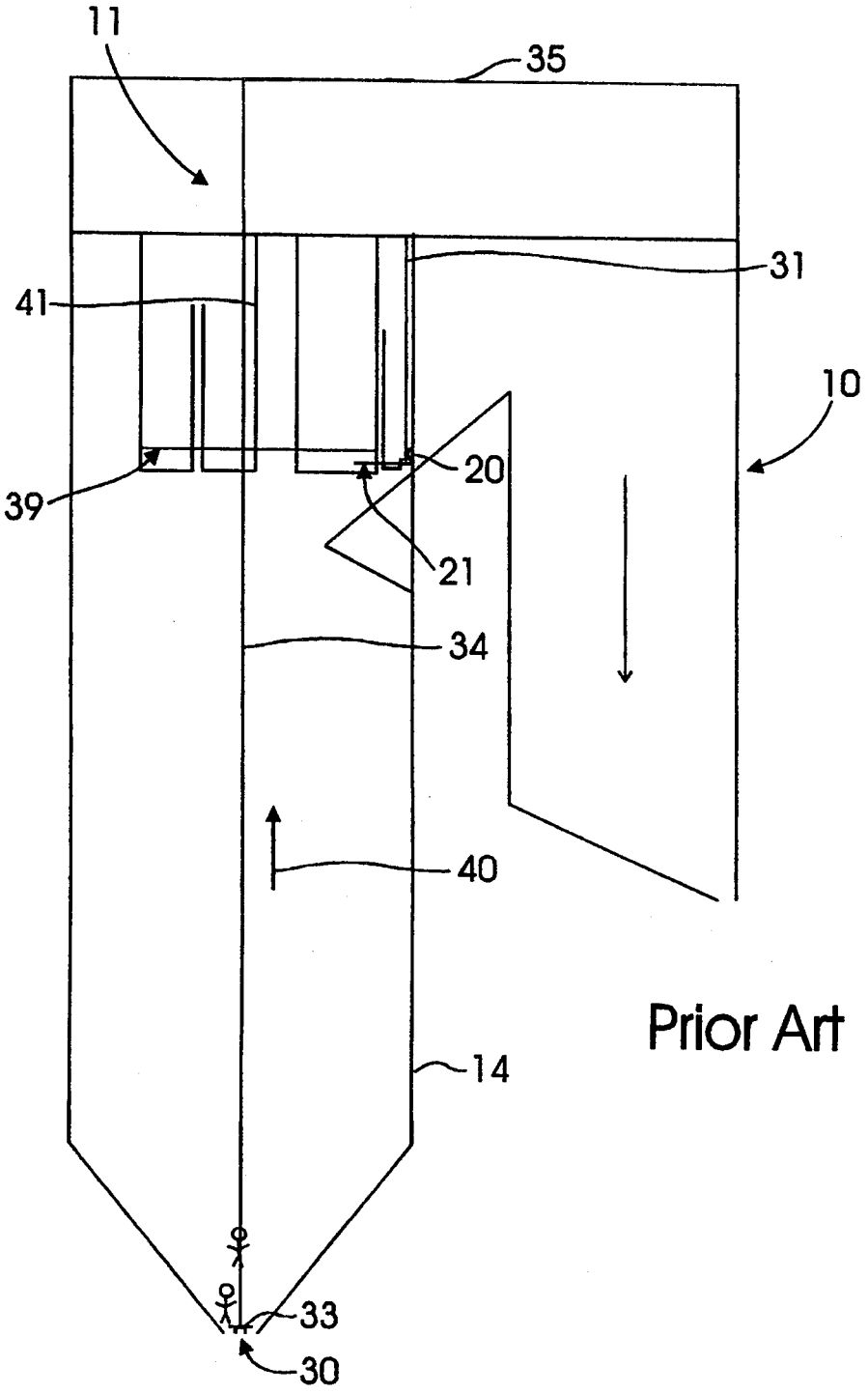
FIG. 1*a* depicts a schematic diagram of a sectional view of a boiler facility containing a firebox with a superheater section being repaired using a prior art procedure.

Now referring to FIG. 1*a*, a schematic view of a power generating boiler 10 is shown. The superheater section, depicted by arrow 11, is shown being repaired by a time-consuming, prior art procedure. The superheater section 11 comprises a pendant section 31 and a platen section 41, each having a plurality of tubes (not shown).

Currently, when repairs are to be made to the tubing, an elaborate procedure is required in order to access the superheater section 11 of the boiler 10. The superheater section 11 is located at least seven to ten stories above the floor of the firebox 14. This superheater section 11 is accessed by a motorized climbing scaffold (not shown) to ferry a crew to the superheater tubes, where the scaffolding must then be constructed.

Before utilizing the motorized scaffolding, however, it is necessary to first construct a scaffolding from the entrance hatchway 20 to the pendant section 31 of the superheater bay 11, as depicted by arrow 21. The tubes of the pendant section 31 and platen section 41 are then deslagged. The deslagging procedure is necessary, because the clinkers that have developed around the superheater tubes during the firing of the boiler 10 can weigh as much as a half-ton. Should these clinkers accidentally break off during the upward travel of the motorized scaffold, serious injury could occur to the scaffold workers. Therefore, it is imperative that these clinkers be initially removed.

An ash hopper throat scaffold 33 is then installed at the ash hopper throat 30 of the firebox 14 to support a motorized scaffolding. The cables 34 for the motorized scaffolding are then lowered from the boiler roof 35 and tied off at the proper length. The motorized scaffold is subsequently assembled on the scaffold 33 of the firebox 14, and a crew is thereafter raised (arrow 40) to the elevation of the platen section 41. A scaffolding 39 is then erected to access the leak in the superheater tubes, using the previously installed pendant scaffold 21 and the motorized scaffold (not shown) as base locations. Thereafter, a leak is repaired by removing the defective section of the tube and welding a new section (not shown) in its place.

Once the repair has been achieved, it then becomes necessary to retrace all of the aforementioned steps to disassemble the scaffold rigging. These steps include removing the pendant scaffold 21; lowering and disassembling the motorized scaffold; removing the motorized scaffold cables 34; and removing the ash hopper throat scaffold 33.

As is evident, the above procedure is quite elaborate, time-consuming and expensive. This procedure is also labor-intensive.

Figure 2:
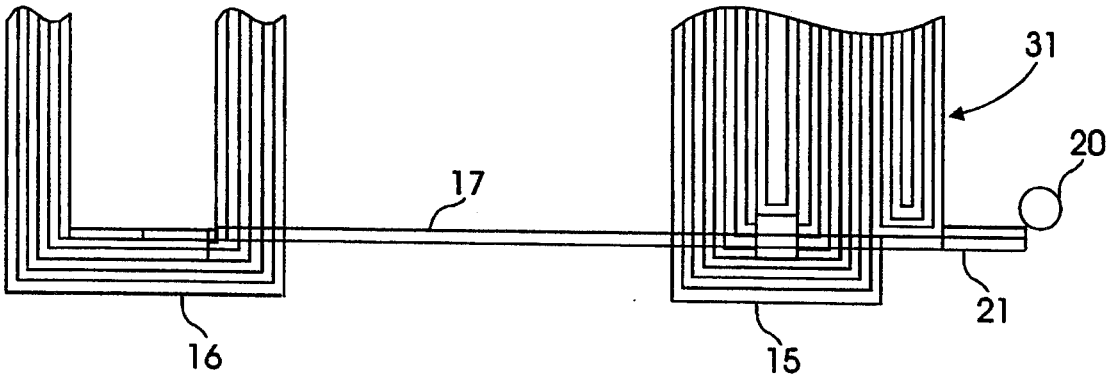
FIG. 2 shows a schematic diagram of a sectional view of the bridge constructed between the firebox inlet and the first tier of the pendant section, and between the first and second tiers of the pendant section of the superheater bay.

Now referring to FIGS. 1 and 2, the present invention incorporates a new type of telescoping scaffolding (depicted in FIGS. 3, 5 and 8) that can access any portion of the superheater from the seventh-story entrance hatch 20. Hence, most of the previously cited procedural steps can be eliminated. The telescoping scaffolding eliminates the need for deslagging, since the motorized scaffolding is no longer required. Installation of the ash hopper throat scaffold 33 (FIG. 1*a*) at the bottom 30 of the firebox 14 and the cabling 34 for the motorized scaffolding are, likewise, no longer necessary.

Figure 8:
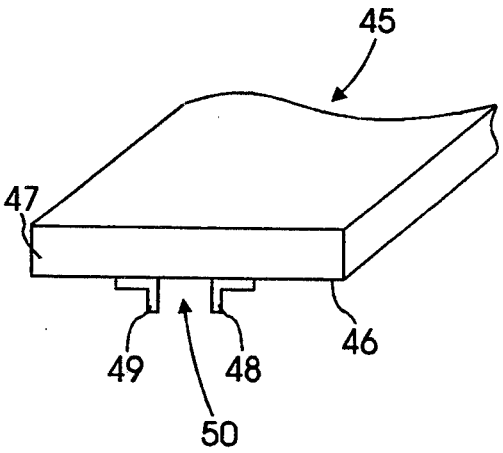
FIG. 8 illustrates a partial, perspective view of a planking member that fits over the telescoping extension bars of the scaffolding frames depicted in FIGS. 3 and 5, forming the walkway of the scaffolds.

Using the new telescoping scaffold of this invention, a scaffold 21 is erected from the entrance hatch 20 to the pendant section 31, as will be explained hereinafter with reference to FIGS. 3 and 8. Thereafter, the telescoping scaffold of this invention is fabricated in situ upon the tubes of the first tier 15 of the pendant section 31. The telescoping scaffold is constructed to form a bridge 17 between the first pendant section 15 and the second pendant section 16.

Figure 3:
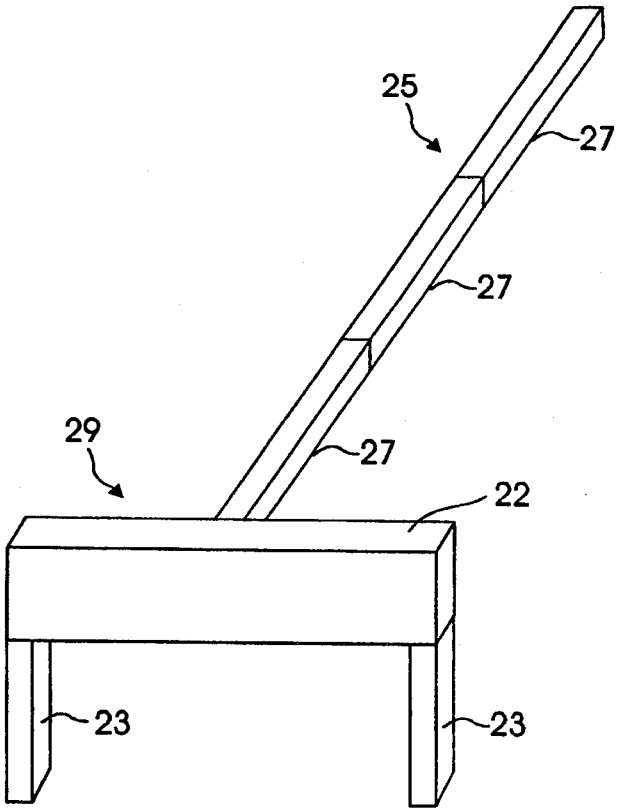
FIG. 3 depicts a schematic, perspective view of the telescoping scaffold frame that is utilized to form a scaffolding bridge between the firebox inlet and the pendant section of the superheater bay, as illustrated in FIG. 2.
Figure 6:
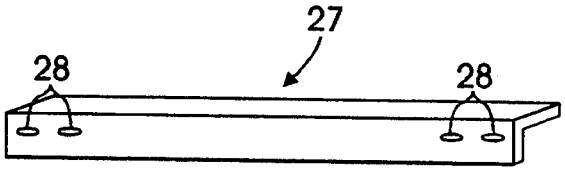
FIG. 6 Shows a perspective view of a typical fulcrum bar used to construct the scaffold frames illustrated in FIGS. 3 and 5.

Referring to FIG. 3, a first telescoping scaffolding frame 29 is shown. The scaffolding frame 29 includes a header member 22 that has two spaced-apart legs 23 and a built-up extension member 25 that is tandemly fabricated in situ from a number of extension bars 27, shown typically in FIG. 6. The tubes of sections 15 and 16 (FIG. 2) are approximately two feet apart. The legs 23 of the header are spaced approximately 30 inches apart to slip over the tubes and anchor the scaffolding frame 29 thereto.

Having the proper length of extension member 25 to form a bridge 17 between pendant sections 15 and 16, the repair workers standing upon the first pendant section 15 construct the scaffolding frame 29. The header member 22 is then swung out from section 15 towards section 16. The legs 23 of the header member 22 are then slipped over the tubes of section 16, locking the scaffolding frame 29 in place. Therefore, the extension member 25 will not shift laterally.

The extension bars 27 are bolted to each other, as well as the header member 22. It is also possible to design these parts with snap-action, locking detents, so that fabrication time can be reduced.

Planking is then laid over the scaffolding frame 29 in order to form a walkway for the workers. A planking member 45 used for this purpose is illustrated in FIG. 8. The planking member 45 comprises a slab 47 having two angle flanges 48 and 49 that are secured to the underside 46. The gap 50 disposed between the angle flanges 48 and 49 forms a channel that accommodates the width of the extension member 25, so that the planking member 45 can be anchored to the scaffolding frame 29 without lateral movement.

Figure 4:
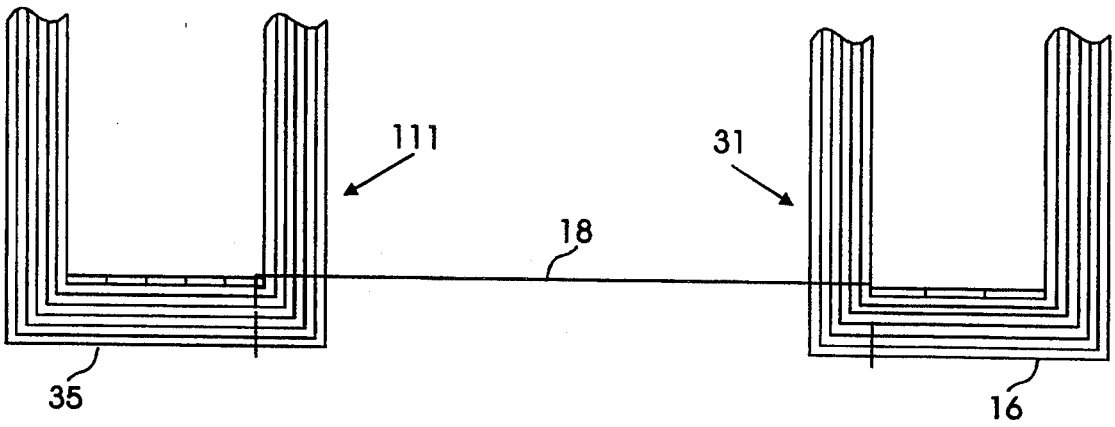
FIG. 4 shows a schematic diagram of a sectional view of the bridge constructed between the pendant section and the first tier of the platen section of the superheater bay.
Figure 7:
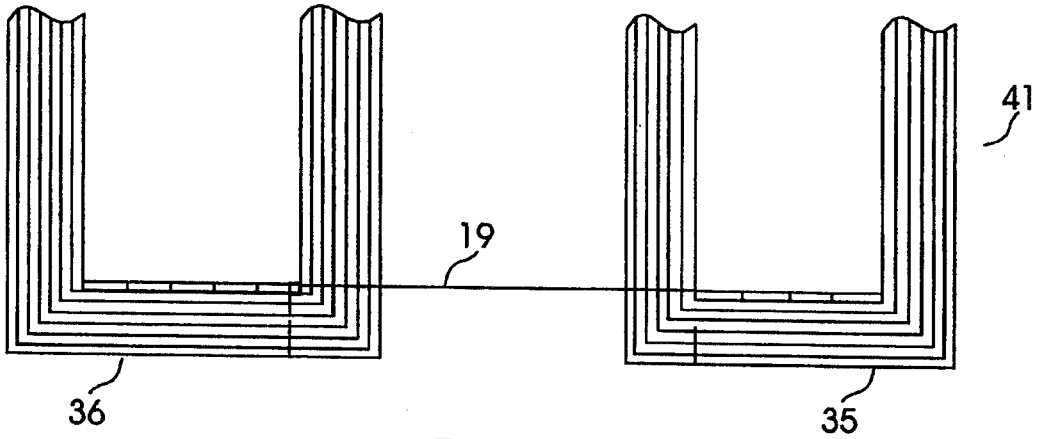
FIG. 7 depicts a schematic diagram of a sectional view of the bridge that is constructed between the first and second tiers of the platen section of the superheater bay.

After the bridge 17 has been constructed for the pendant sections 15 and 16, respectively, it is then necessary to construct in situ a bridge 18 from the tier 16 of the pendant section 31 to the first tier 35 of the platen section 41, as illustrated in FIG. 4, and, thereafter, to fabricate a bridge 19 from the first tier 35 to the second tier 36 of the platen section 41, as shown in FIG. 7.

Figure 5:
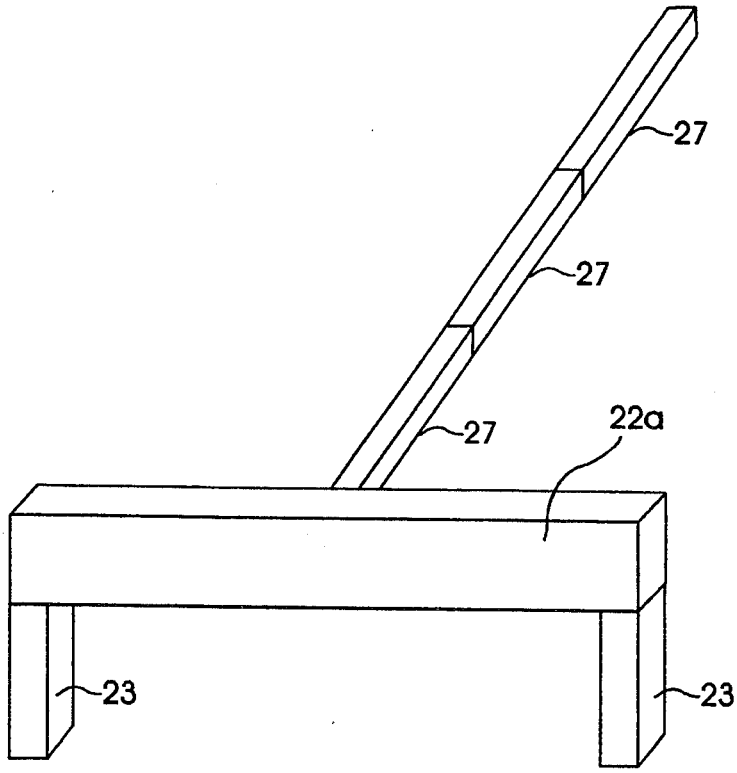
FIG. 5 depicts a schematic, perspective view of the telescoping scaffold frame that is utilized to form a scaffolding bridge between the pendant section and the first tier of the platen section of the superheater bay, as illustrated in FIG. 4.

The tubes of the platen section are approximately four feet apart. Therefore, the legs 23 of the header member 22*a* should be spaced approximately five feet apart, as illustrated in FIG. 5. Other than having a larger header member 22*a*, the attendant procedures are then the same for the construction of bridges 18 and 19. Planking member 45 is used to create a walkway for bridges 18 and 19 in a similar fashion as bridge 17.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A telescoping-type scaffolding constructed in situ among tiers of tubes disposed in a boiler, comprising:

a header member having two spaced-apart legs that are designed to be placed over and in between tubes in a tier of tubes of a boiler section disposed in a boiler firebox, said legs being used to anchor said header member with respect to said tubes and to provide a bridge for workers;

an extension member extending from said header member for bridging a gap disposed between tiers of tubes to be reached, said extension member comprising tandemly attached extension bars that are attached in situ, projected from the header member to a length necessary to bridge the gap between the tiers of tubes; and a planking member disposed upon said extension member in order to provide a walkway for workers to enable them to cross from one tier of tubes to an adjacent tier of tubes.

2. The telescoping-type scaffolding in accordance with claim 1, wherein said planking member further comprises two spaced-apart flange angle members that form a channel for said extension member for anchoring said planking member thereto.

3. A telescoping-type scaffolding constructed in situ among tiers of tubes of a superheater section disposed in an elevated section of a power-generating boiler, comprising:

a header member having two spaced-apart legs that are designed to be placed over and in between tubes in a tier of tubes disposed in a superheater section of a boiler, said legs being used to anchor said header member with respect to said tubes and to provide a bridge for workers;

a telescoping-type extension member extending from said header member for bridging a gap disposed between tiers of tubes to be reached in said superheater section, said extension member comprising tandemly attached extension bars that are attached in situ in telescoping fashion and that project from the header member to a length necessary to bridge the gap between the tiers of tubes; and a planking member disposed upon said extension member in order to provide a walkway for workers to enable them to cross from one tier of tubes to an adjacent tier of tubes.

4. The telescoping-type scaffolding in accordance with claim 3, wherein said planking member further comprises two spaced-apart flange angle members that form a channel for said extension member for anchoring said planking member thereto.

5. A method of repairing tubes in a superheater bay disposed in a firebox of a power-generating boiler, comprising the steps of:

a) fabricating in situ a telescoping-type scaffolding frame in which extension lengths are attached in sections to provide bridges between:

i) an access hatch at a superheater level of a firebox and a first tier of a pendant section of a superheater bay, ii) a first tier and second tier of a pendant section of the superheater bay, iii) the pendant section and a platen section of the superheater bay, and iv) a first tier and a second tier of the platen section of the superheater bay; and b) placing planking upon said telescoping-type scaffolding frame to provide a walkway for workman passing across said bridges.

6. The method in accordance with claim 5, wherein said telescoping-type scaffolding frame is fabricated in situ with respect to step (a) by tandemly attaching extension bars together until a length is achieved that is sufficient to bridge said tiers of said superheater bay.

* * * * *